US011111692B1

(12) United States Patent
Qureshi

(10) Patent No.: US 11,111,692 B1
(45) Date of Patent: Sep. 7, 2021

(54) ILLUMINATED STRUCTURE

(71) Applicant: Aduiq Rahman Qureshi, Charlotte, NC (US)

(72) Inventor: Aduiq Rahman Qureshi, Charlotte, NC (US)

( * ) Notice: Subject to any disclaimer, the term of this patent is extended or adjusted under 35 U.S.C. 154(b) by 0 days.

(21) Appl. No.: 16/845,592

(22) Filed: Apr. 10, 2020

(51) Int. Cl.

| | |
|---|---|
| ***E04H 15/10*** | (2006.01) |
| ***F21V 23/00*** | (2015.01) |
| ***F21S 4/20*** | (2016.01) |
| ***F21S 10/02*** | (2006.01) |
| ***F21V 33/00*** | (2006.01) |
| ***A45B 23/00*** | (2006.01) |
| ***F21W 131/301*** | (2006.01) |
| ***F21Y 115/10*** | (2016.01) |
| ***F21V 21/22*** | (2006.01) |
| ***F21V 15/01*** | (2006.01) |

(52) U.S. Cl.
CPC ..... *E04H 15/10* (2013.01); *A45B 23/00* (2013.01); *F21S 4/20* (2016.01); *F21S 10/02* (2013.01); *F21V 23/003* (2013.01); *F21V 33/006* (2013.01); *F21V 33/0012* (2013.01); *F21V 33/0056* (2013.01); *A45B 2200/1018* (2013.01); *F21V 15/012* (2013.01); *F21V 21/22* (2013.01); *F21W 2131/301* (2013.01); *F21Y 2115/10* (2016.08)

(58) Field of Classification Search
CPC ..... E04H 15/10; F21S 4/20; F21S 4/22; F21S 4/24; F21S 4/26; F21S 4/28; A45B 2200/1018; A45B 3/02; F21V 33/0012; F21V 33/0024; F21V 33/006; F21W 2131/301; A47B 2220/0075
See application file for complete search history.

(56) References Cited

U.S. PATENT DOCUMENTS

| | | | | |
|---|---|---|---|---|
| 5,463,535 | A * | 10/1995 | Vest | A45B 3/04 135/16 |
| 6,612,713 | B1 * | 9/2003 | Kuelbs | A45B 3/00 362/102 |
| 6,773,140 | B2 * | 8/2004 | Lee | E04H 15/10 135/121 |
| 7,661,836 | B1 * | 2/2010 | Naranjo | A45B 3/04 362/102 |
| 8,176,745 | B1 * | 5/2012 | Korza | A63B 67/066 62/258 |
| 9,713,368 | B1 * | 7/2017 | Kuelbs | A45B 3/00 |
| 2008/0053496 | A1 * | 3/2008 | Li | A45B 3/02 135/16 |

(Continued)

OTHER PUBLICATIONS

ISA/US; International Search Report and Written Opinion for International Patent Application No. PCT/US2020/044837 dated Sep. 21, 2020, 10 pages.

*Primary Examiner* — Alexander K Garlen
*Assistant Examiner* — Colin J Cattanach
(74) *Attorney, Agent, or Firm* — NK Patent Law

(57) ABSTRACT

An illuminated structure is disclosed, comprising a plurality of lighting elements disposed within a semi-transparent frame configured as a portable item. A microcontroller controls the light emitted by the plurality of lighting elements and a memory is in operable communication with the microcontroller. The memory is configured to store operational instructions transmitted to the microcontroller to customize the output of each of the plurality of lighting elements.

19 Claims, 4 Drawing Sheets

(56) References Cited

U.S. PATENT DOCUMENTS

| | | | | |
|---|---|---|---|---|
| 2009/0090404 | A1* | 4/2009 | Kuelbs | A45B 3/04 135/16 |
| 2011/0203494 | A1* | 8/2011 | Ashby | A47B 3/087 108/127 |
| 2013/0271966 | A1* | 10/2013 | Doble | F21V 23/026 362/183 |
| 2013/0335972 | A1* | 12/2013 | Hubner | B60Q 1/2657 362/253 |
| 2014/0009915 | A1* | 1/2014 | Nievas | A45B 3/04 362/102 |
| 2014/0096805 | A1* | 4/2014 | Silva | E04H 15/18 135/91 |
| 2014/0268864 | A1* | 9/2014 | Lee | G02B 6/0008 362/558 |
| 2015/0034137 | A1* | 2/2015 | Tanaeim | E04H 15/54 135/91 |
| 2015/0300627 | A1* | 10/2015 | Wang | F21S 9/02 108/23 |
| 2016/0363310 | A1* | 12/2016 | Powell | F21V 33/0012 |
| 2017/0292285 | A1* | 10/2017 | Jin | E04H 15/60 |
| 2018/0135849 | A1* | 5/2018 | Paseta | A47K 3/38 |
| 2018/0187447 | A1* | 7/2018 | Gharabegian | E04H 15/28 |
| 2019/0167826 | A1* | 6/2019 | Winslow | A61N 5/0624 |
| 2019/0211577 | A1* | 7/2019 | Gharabegian | G05B 19/4155 |
| 2019/0293278 | A1* | 9/2019 | McNae | A47C 31/008 |
| 2020/0066266 | A1* | 2/2020 | Gharabegian | A45B 25/165 |

* cited by examiner

ILLUMINATED STRUCTURE

FIELD

The embodiments relate to canopies and, more specifically, relate to canopies and similar temporary and/or permanent structures having luminary components.

BACKGROUND

Businesses often utilize customized canopies and similar temporary structures to advertise their business while sheltering individuals from the elements. Canopies may be permanent or collapsible and constructed of metal or wood. Collapsible canopies include a metal frame with a fabric roof. The frame is universal while the fabric is customized with colors and signage for the particular business. Similar structures such as umbrellas also use a standard frame with a customizable fabric cover.

Most canopies offer few options for users to customize the appearance of their components. Further, no canopies exist which integrate with a user's computing device to allow for on-demand customization of the appearance of the canopies to help businesses stand out from their competitors.

Similarly, businesses and individuals alike utilize temporary structures including folding tables, folding chairs, umbrellas, etc. These items are often easily transportable and may be applied to various settings; however, few of these items are customizable to allow the individual to customize the item to their home, business logo, mood, surrounding environment, or other preferences.

Advances in light-emitting diode (LED) technology have allowed their disposal in various structures. LED's are easily programmable to emit visible, ultraviolet, and infrared wavelengths and have a low energy consumption, longer lifespan, smaller size, and fast switching making them ideal for portable items.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments disclosed herein provide an illuminated structure comprising a plurality of lighting elements disposed within a transparent or semi-transparent frame, configured as a portable item. A microcontroller controls the light emitted by the plurality of lighting elements, and a memory is in operable communication with the microcontroller. The memory is configured to store operational instructions transmitted to the microcontroller to customize the output of each of the plurality of lighting elements.

The embodiments provide a means for customizing a structure using programmable light emitting diodes to allow the user to adjust various aspects of the appearance of the structure. For example, a business may utilize the illuminated structure by matching the color of the lighting elements to the business colors in order to draw attention to the business. In another example, the structure may be illuminated to provide light to the surrounding environment of the structure.

In one aspect, the transparent or semi-transparent frame and lighting elements therein allow for users to customize the appearance and direct attention to their structure.

In other aspects, the structure may be configured as a canopy, a tent, an awning, an umbrella, or similar structure providing shelter to an area.

In one aspect, the roof of the structure includes customized advertising materials. The roof may be removably engaged with the frame to allow for the exchange of roofs having various customized designs, markings, patterns, or insignia thereon.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
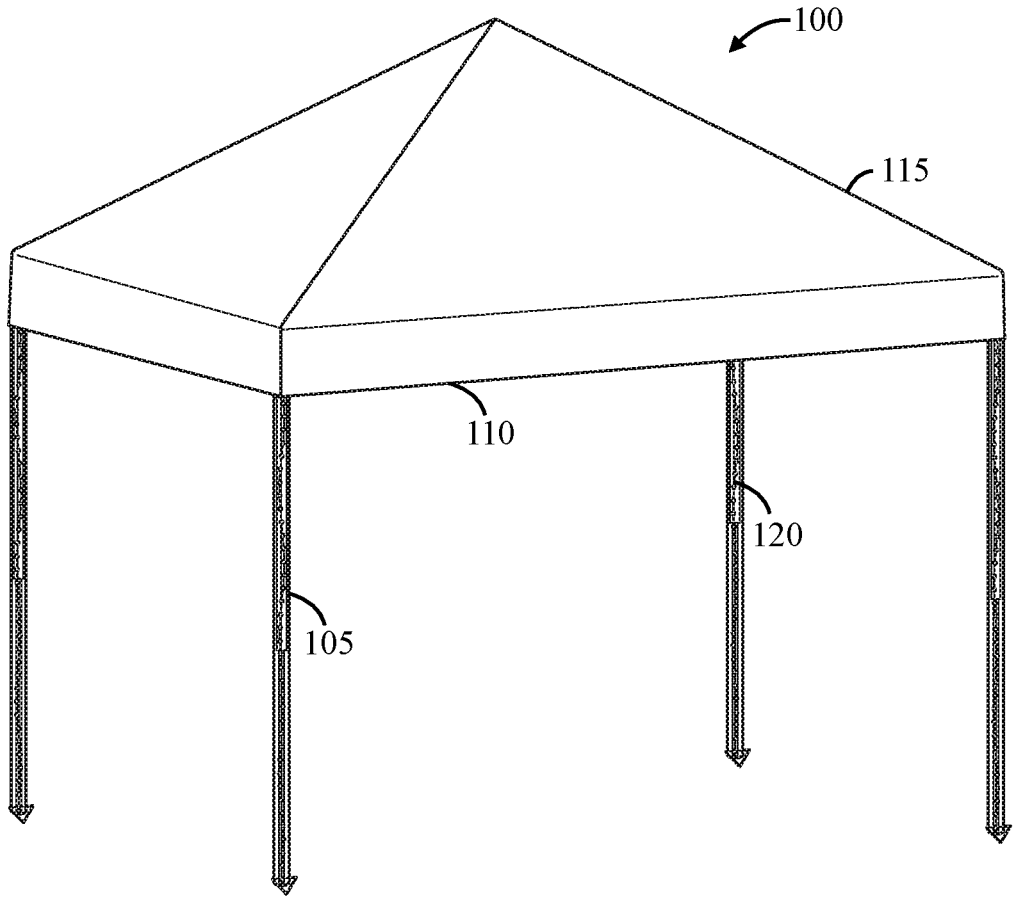
FIG. 1 illustrates a perspective view of the illuminated canopy, according to some embodiments.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments presented include a structure having a frame. The frame may be provided as a permanent structure having rigid legs supporting a fabric canopy. The frame can also be collapsible to facilitate storage and transportation of the canopy. A plurality of supports extend between the frame to provide rigidity to the structure and support the roof.

FIG. 1 illustrates the illuminated structure 100 having a frame 105 arranged as a canopy 110. The frame 105 is a semi-transparent frame 105 to provide support to a roof 115. A plurality of lighting elements 120 are disposed within the semi-transparent frame 105, which permits the emission of light from the plurality of lighting elements 120 through the semi-transparent frame 105 to allow the customization of the appearance of the structure 100 via a microcontroller in communication with the plurality of lighting elements 120.

In some embodiments, the lighting element elements 120 are a light-emitting diodes (LED's) to provide a modular light source which may be programmable by a user.

In some embodiments, the frame 105 is a fully transparent frame 105.

In some embodiments, the frame includes a power source to supply power to a plurality of lights positioned in the frame. The power source can include a rechargeable battery or a power supply adapter as is known in the arts. A high current converter may be provided to reduce the voltage from 12V if light emitting diodes (LED's) are used.

In some embodiments, the illuminated structure 100 may comprise a plurality of power outlets and/or USB ports to provide a means for receiving power from the illuminate structure for charging computing devices or other electronic devices.

In some embodiments, the frame 105 of the illuminated structure 100 may further comprise a WiFi router or other wireless or wired communication technology known in the arts for providing permitted users a means to connect to the internet or a local network within a proximity of the structure 100.

Figure 2:
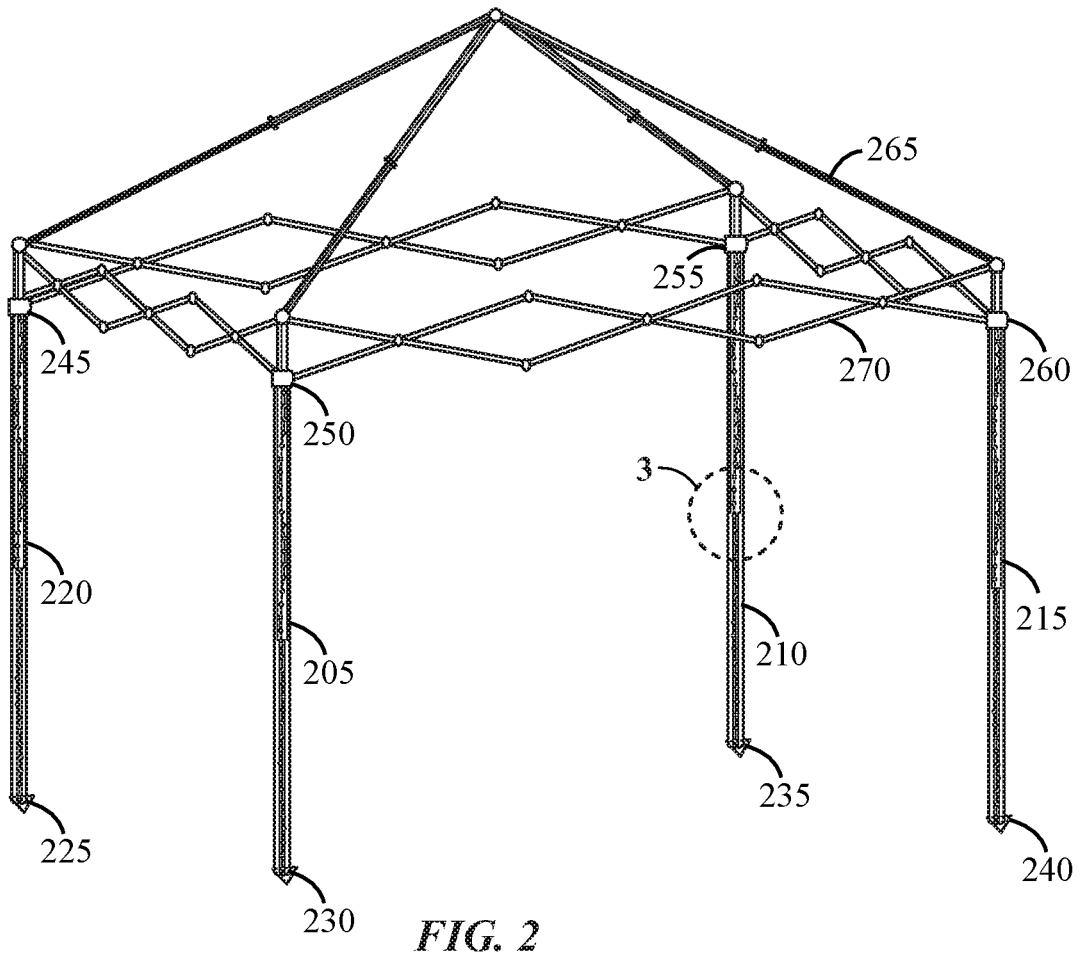
FIG. 2 illustrates a perspective view of the illuminated canopy frame, according to some embodiments.

FIG. 2 illustrates the semi-transparent frame 105 configured as an illuminated canopy comprising a plurality of supports 205, 210, 215, 220 each comprising a base 225, 230, 235, 240 and a receiver 245, 250, 255, 260 to receive the roof frame 265. The roof frame is comprised of a plurality of lateral supports 270. Each lateral support 270 may be semi-transparent and configured to receive one or more lighting elements therein such that the lateral supports 270 may be illuminated.

In some embodiments, the lateral supports 270 and the supports 205, 210, 215, 220 may be programmable to emit different light colors, patterns, or intensities.

Figure 3:
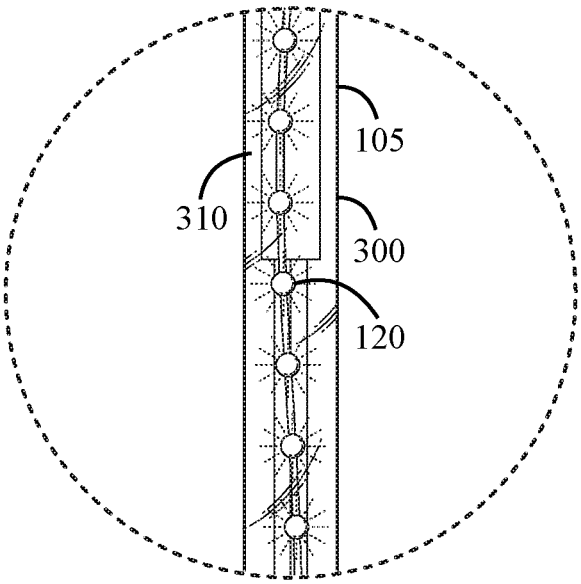
FIG. 3 illustrates a detail view of the illuminated frame including the lighting elements, according to some embodiments.

FIG. 3 illustrates a detail view of the semi-transparent frame 105 and the lighting elements 120 therein. The semi-transparent frame 105 comprises a plurality of sidewalls 300 to form an interior 310 which may be configured in various shapes including cuboid structures, cylinders, or similar shapes to retain a plurality of lighting elements 120. The semi-transparent frame 105 provides a suitably protective barrier between the lighting elements 120 and the external environment. One skilled in the arts will readily understand that the semi-transparent frame may be configured in various sizes, shapes, and configurations to be utilized for various illuminated items. The items may include chairs, umbrellas, gazebos, tables, and similar structures which are commonly portable, while the embodiments are not constrained by portability.

In some embodiments, the semi-transparent frame 105 may be extendable and retractable as is known in the arts. For example, the semi-transparent frame 105 may include telescoping members to allow the supports to extend and raise the height of the canopy.

Figure 4:
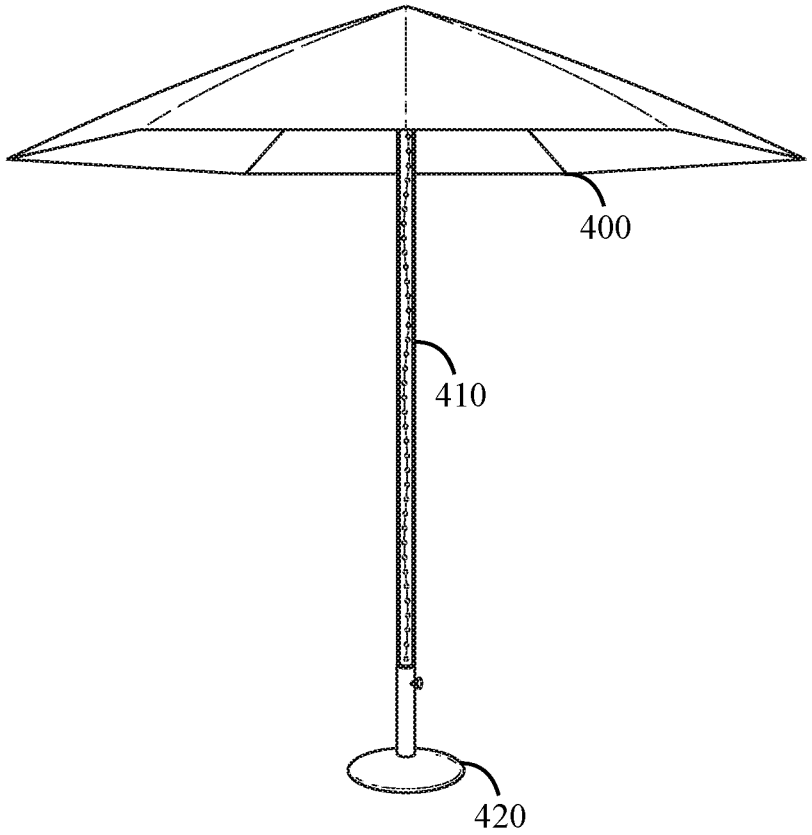
FIG. 4 illustrates a perspective view of an illuminated patio umbrella, according to some embodiments.
Figure 5:
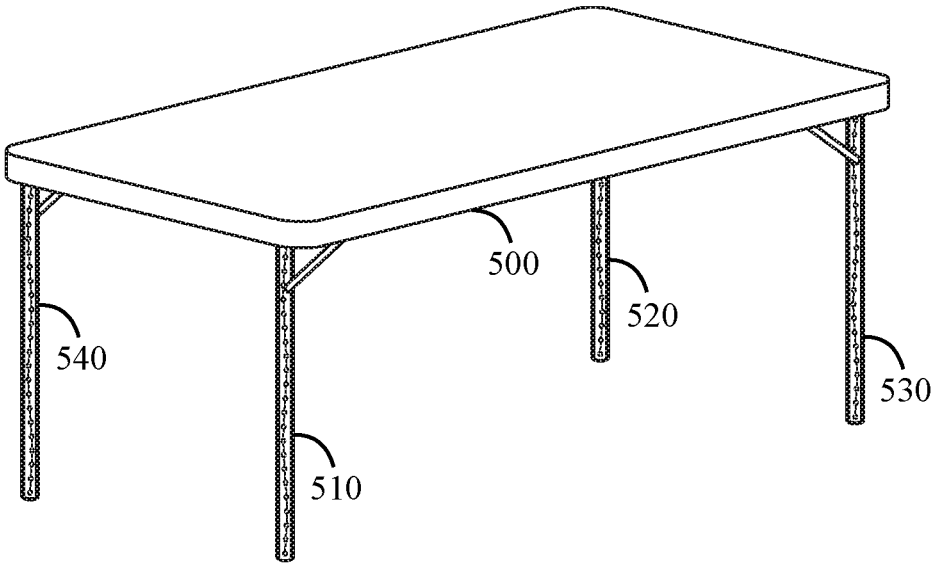
FIG. 5 illustrates a perspective view of an illuminated folding table, according to some embodiments.

FIG. 4 illustrates an illuminated umbrella 400 comprising an illuminated pole 410 extending from an umbrella base 420 to an umbrella canopy 430. FIG. 5 illustrates an illuminated table 500 comprising a plurality of semi-transparent legs 510, 520, 530, 540. Both the illuminated umbrella 400 and the illuminated table may be in communication with a computing device to modify the appearance of the structure.

Figure 6:
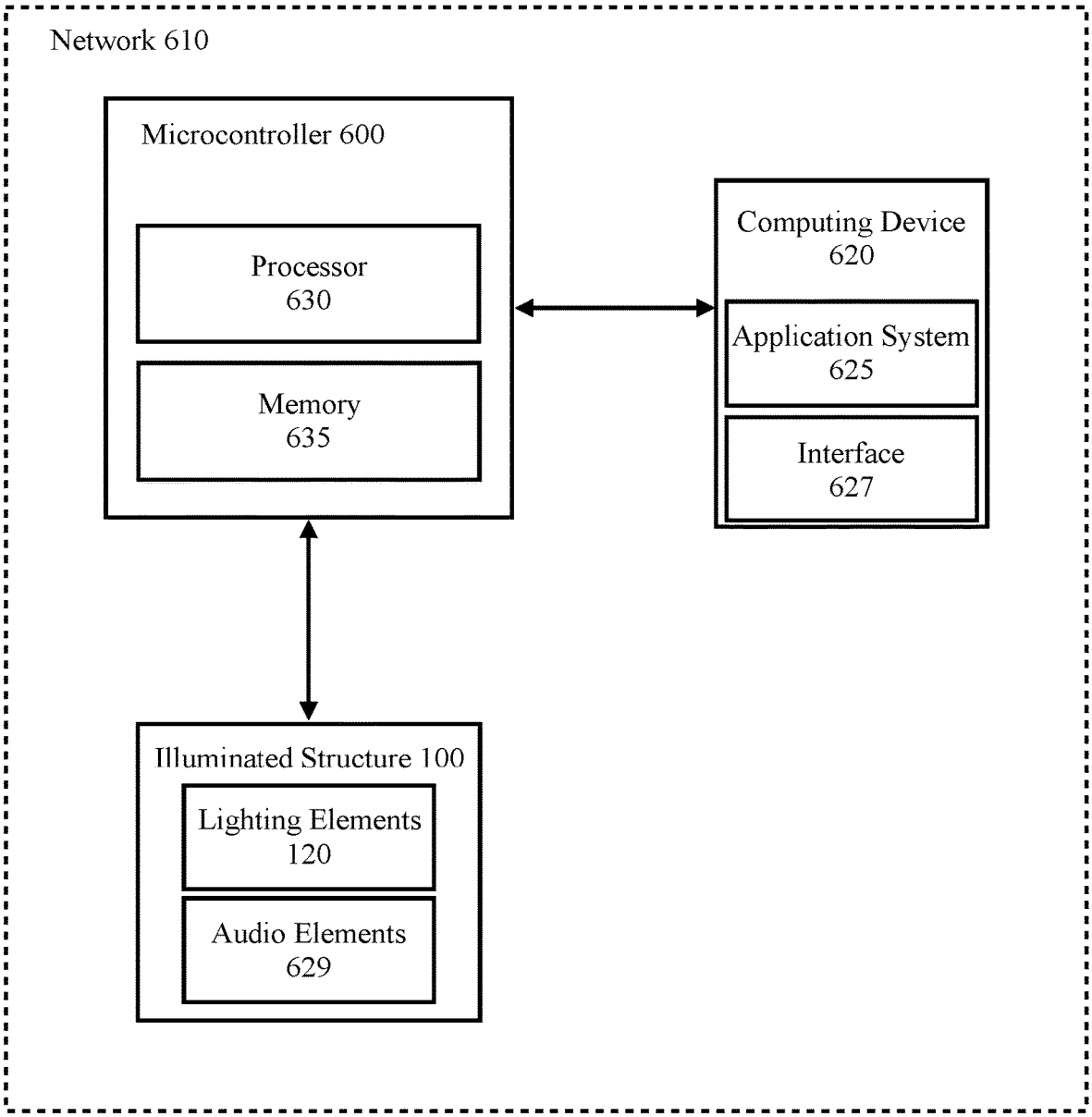
FIG. 6 illustrates a schematic of the system infrastructure, according to some embodiments.

FIG. 6 illustrates a microcontroller 600 and processor 630 in communication with the lighting elements 120 of the illuminated structure 100. The microcontroller 600 can operate using open source hardware programmed to have various color, intensity, or light pattern. The microcontroller 600 is in communication with a computing device 620 having an input/output device to provide an interface 627 and commands to the microcontroller 600. The interface 627 is provided via an application system 625 downloaded to the computing device 620. A processor executed instructions stored in a memory module. The computing device 620 can include a personal electronic device such as a mobile phone or tablet. The microcontroller 600 is in communication with a memory 635 of stored commands executed by the processor 130. Each command can be preprogrammed using various user settings input on the computing device. The memory 635 stores a plurality of operational modes to change the color, intensity, and pattern of light emitted by the lighting elements 120. Further one or more audio elements 629 are attached to the illuminated structure 100 and in communication with the microcontroller 600 to provide programmable sound to the illuminated structure 100. The memory 635 may be configured to store audio information which may be transmitted to the audio elements 629.

In some embodiments, the structure is comprised of one or more transparent surfaces configured as a housing for the plurality of lighting elements 120 and electrical components thereof. The lighting elements 120 are powered via a power source. The transparent surfaces allow for light to pass therethrough and illuminate the frame of the structure. The color, intensity, light pattern, and routine can be selectively programmed using the computing device 620 in wireless communication with the microcontroller 600.

In some embodiments, the frame is constructed having one or more semi-transparent surfaces which may include plastics, metals, polymers, organic materials, and combinations thereof.

In some embodiments, the structure may be configured as a canopy, a tent, an awning, an umbrella, or similar structure providing shelter to an area. Each configuration may be permanent, collapsible, and/or portable.

In some embodiments, the roof of the structure includes customized advertising materials. The roof may be removably engaged with the frame to allow for the exchange of roofs having various customized designs, markings, patterns, or insignia thereon. The computing device may change the lighting elements to correspond to the roof.

The memory module may include a computer readable medium storing the application, which may include instructions. In an embodiment, the memory module may contain different components for retrieving, presenting, changing, and saving data and may include computer-readable media. The memory module may include a variety of memory devices, for example, Dynamic Random-Access Memory (DRAM), Static RAM (SRAM), flash memory, cache memory, and other memory devices. Additionally, for example, a memory module and processors may be distributed across several different computing devices that collectively comprise a system. The memory module is capable of storing each user-generated information to be displayed on the computing device display.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A framed structure configured for providing illumination for an occupant via wireless control, the framed structure comprising:

a frame comprising:

a collapsible roof frame configured to support a fabric roof for sheltering individuals; and a first semi-transparent telescoping vertical support pole configured to be mechanically coupled with a receiver of the collapsible roof frame, wherein the first semi-transparent telescoping vertical support pole comprises:

a first semi-transparent supporting section having a first centralized hollow cavity; and a second semi-transparent supporting section having a second centralized hollow cavity and positioned at least partially within the first semi-transparent supporting section and configured to adjust a height of the collapsible roof frame;

a first plurality of lighting elements disposed within the first centralized hollow cavity and the second centralized hollow cavity, wherein:

the first plurality of lighting elements is configured to provide light to a surrounding environment of the framed structure and illuminate the framed structure;

the framed structure is configured as a portable item; and the first semi-transparent telescoping vertical support pole provides a protective barrier between the first plurality of lighting elements and an external environment while allowing 360 degree emission of light of each lighting element of the first plurality of lighting elements; and a microcontroller electrically coupled with the first plurality of lighting elements, the microcontroller configured for:

wirelessly receiving a first command from an external computing device, wherein the first command is received upon a selection of a color for the first plurality of lighting elements by a user of the external computing device;

wirelessly receiving a second command from the external computing device, wherein the second command is received upon a selection of an intensity for the first plurality of lighting elements by the user of the external computing device; and wirelessly receiving a third command from the external computing device, wherein the third command is received upon a selection of a pattern for the first plurality of lighting elements by the user of the external computing device.

2. The framed structure of claim 1, wherein the first plurality of lighting elements are light-emitting diodes (LEDs).

3. The framed structure of claim 1 further comprising the fabric roof, wherein the color corresponds to a color displayed on the fabric roof.

4. The framed structure of claim 1 further comprising one or more audio components in communication with the microcontroller.

5. The framed structure of claim 1, wherein the framed structure is configured to be an umbrella when implemented with the fabric roof.

6. The framed structure of claim 5 further comprising an umbrella base configured to be mechanically coupled with the first semi-transparent telescoping vertical support pole.

7. The framed structure of claim 1, wherein the first plurality of lighting elements is configured to transverse the first semi-transparent supporting section and the second semi-transparent supporting section.

8. The framed structure of claim 7 further comprising the fabric roof, wherein the fabric roof is substantially rectangular in shape.

9. The framed structure of claim 7 further comprising the fabric roof, wherein the fabric roof is substantially square in shape.

10. The framed structure of claim 1, wherein the framed structure is configured to be a canopy when implemented with the fabric roof.

11. The framed structure of claim 10 further comprising:

a second semi-transparent telescoping vertical support pole mechanically coupled with the collapsible roof frame;

a second plurality of lighting elements disposed within the second semi-transparent telescoping vertical support pole;

a third semi-transparent telescoping vertical support pole mechanically coupled with the collapsible roof frame;

a third plurality of lighting elements disposed within the third semi-transparent telescoping vertical support pole;

a fourth semi-transparent telescoping vertical support pole mechanically coupled with the collapsible roof frame; and a fourth plurality of lighting elements disposed within the fourth semi-transparent telescoping vertical support pole.

12. The framed structure of claim 11 further comprising the fabric roof, wherein the fabric roof is substantially rectangular in shape.

13. The framed structure of claim 11 further comprising the fabric roof, wherein the fabric roof is substantially square in shape.

14. The framed structure of claim 11 wherein:

the first semi-transparent telescoping vertical support pole comprises a first semi-transparent section and a second semi-transparent section;

the second semi-transparent telescoping vertical support pole comprises a third semi-transparent section and a fourth semi-transparent section;

the third semi-transparent telescoping vertical support pole comprises a fifth semi-transparent section and a sixth semi-transparent section; and the fourth semi-transparent telescoping vertical support pole comprises a seventh semi-transparent section and an eighth semi-transparent section.

15. The framed structure of claim 14, wherein:

the first plurality of lighting elements is configured to transverse the first semi-transparent section and the second semi-transparent section;

the second plurality of lighting elements is configured to transverse the third semi-transparent section and the fourth semi-transparent section;

the third plurality of lighting elements is configured to transverse the fifth semi-transparent section and the sixth semi-transparent section; and the fourth plurality of lighting elements is configured to transverse the seventh semi-transparent section and the eighth semi-transparent section.

16. The framed structure of claim 1 further comprising a rechargeable battery for powering the first plurality of lighting elements.

17. The framed structure of claim 16 further comprising a WiFi router for providing a local network.

18. The framed structure of claim 17 further comprising a plurality of USB ports configured to receive power for the rechargeable battery.

19. The framed structure of claim 18, wherein:

the external computing device is at least one device selected from the group consisting of a mobile phone and a tablet; and the external computing device includes an interface provided by a downloaded application configured to provide the first command, the second command, and the third command to the microcontroller.

* * * * *